US010167700B2

(12) United States Patent
Brasseaux et al.

(10) Patent No.: US 10,167,700 B2
(45) Date of Patent: Jan. 1, 2019

(54) VALVE OPERABLE IN RESPONSE TO ENGAGEMENT OF DIFFERENT ENGAGEMENT MEMBERS

(71) Applicant: WEATHERFORD TECHNOLOGY HOLDINGS, LLC, Houston, TX (US)

(72) Inventors: Jason J. Brasseaux, Cypress, TX (US); Brian J. Ritchey, Hockley, TX (US); Joshua M. Hornsby, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 355 days.

(21) Appl. No.: 15/012,570

(22) Filed: Feb. 1, 2016

(65) Prior Publication Data

US 2017/0218723 A1 Aug. 3, 2017

(51) Int. Cl.
*E21B 34/10* (2006.01)
*E21B 33/12* (2006.01)
(Continued)

(52) U.S. Cl.
CPC ..... *E21B 34/10* (2013.01); *E21B 33/12* (2013.01); *E21B 43/04* (2013.01); *E21B 43/045* (2013.01);
(Continued)

(58) Field of Classification Search
CPC .... E21B 34/10; E21B 34/12; E21B 2034/005; E21B 2034/007
See application file for complete search history.

(56) References Cited

U.S. PATENT DOCUMENTS 3,221,820 A 12/1965 Myers
3,845,818 A * 11/1974 Deaton ..... E21B 34/105 137/629
(Continued)

FOREIGN PATENT DOCUMENTS

WO 2016/108886 7/2016

OTHER PUBLICATIONS

Office Action dated Nov. 30, 2017 for U.S. Appl. No. 15/012,453, 21 pages.
(Continued)

*Primary Examiner* — Matthew R Buck
*Assistant Examiner* — Aaron L Lembo
(74) *Attorney, Agent, or Firm* — Smith IP Services, P.C.

(57) ABSTRACT

A system can include a tubular string having at least two internal profiles, and a valve assembly reciprocably disposed in the tubular string. The valve assembly is actuated to a closed configuration in response to displacement of the valve assembly through one internal profile, and the valve assembly is actuated to an open configuration in response to displacement of the valve assembly through another internal profile. A method of gravel packing a well can include displacing a service string in opposite longitudinal directions within a completion assembly, the service string including a valve assembly that selectively restricts flow through a longitudinal flow passage of the service string, opening the valve assembly as the valve assembly displaces in one longitudinal direction, and closing the valve assembly as the valve assembly displaces in the opposite longitudinal direction.

17 Claims, 11 Drawing Sheets

(51) Int. Cl.
*E21B 43/04* (2006.01)
*E21B 43/08* (2006.01)
*E21B 34/00* (2006.01)

(52) U.S. Cl.
CPC ..... *E21B 43/08* (2013.01); *E21B 2034/007* (2013.01)

(56) References Cited

U.S. PATENT DOCUMENTS 3,981,358 A * 9/1976 Watkins ..... E21B 34/102 166/323
4,105,069 A 8/1978 Baker
4,356,867 A * 11/1982 Carmody ..... E21B 34/102 166/237
4,411,316 A * 10/1983 Carmody ..... E21B 34/102 166/323
4,423,773 A * 1/1984 Stout ..... E21B 34/063 166/317
4,624,315 A * 11/1986 Dickson ..... E21B 34/102 166/323
4,703,805 A * 11/1987 Morris ..... E21B 34/101 166/324
4,722,392 A 2/1988 Proctor et al.
4,729,432 A * 3/1988 Helms ..... E21B 21/10 166/317
4,796,705 A * 1/1989 Carmody ..... E21B 34/102 166/321
4,858,690 A 8/1989 Rebardi et al.
5,413,180 A 5/1995 Ross et al.
5,479,989 A 1/1996 Shy et al.
5,823,265 A 10/1998 Crow et al.
6,902,006 B2 * 6/2005 Myerley ..... E21B 29/08 166/332.8
7,387,164 B2 * 6/2008 Pringle ..... E21B 23/006 166/305.1
7,717,185 B2 * 5/2010 Anderson ..... E21B 34/102 166/332.8
7,980,316 B2 7/2011 Swenson et al.
8,881,824 B2 11/2014 Stautzenberger
9,371,711 B2 * 6/2016 Foubister ..... E21B 33/1294
9,416,599 B2 * 8/2016 Bailey ..... E21B 19/16
9,428,998 B2 * 8/2016 Turley ..... E21B 43/10
9,441,456 B2 * 9/2016 Hill, Jr. ..... E21B 34/102
9,518,445 B2 * 12/2016 Noske ..... E21B 34/06
2005/0189117 A1 * 9/2005 Pringle ..... E21B 23/006 166/369
2009/0301732 A1 12/2009 Turner et al.
2013/0068476 A1 3/2013 Edwards
2017/0067315 A1 * 3/2017 Mailand ..... E21B 34/10
2017/0292347 A1 * 10/2017 Mailand ..... E21B 34/10

OTHER PUBLICATIONS

Specification and Drawings for U.S. Appl. No. 15/012,453, filed Feb. 1, 2016, 42 pages.
Halliburton; "Reverse Position Indicators", company brochure, Downhole Sand Components (3-43-3-44), received Jan. 12, 2016, 1 page.
Combined Search and Examination Report dated Jun. 1, 2017 for UK Patent Application No. GB1701641.1, 5 pages.
Australian Examination Report dated Mar. 27, 2018 for AU Patent Application No. 2017200611, 6 pages.

* cited by examiner

VALVE OPERABLE IN RESPONSE TO ENGAGEMENT OF DIFFERENT ENGAGEMENT MEMBERS

BACKGROUND

This disclosure relates generally to equipment and operations utilized in conjunction with subterranean wells and, in an example described below, more particularly provides a downhole valve, and associated systems and methods.

Valves operable downhole can be used in gravel packing operations in wells. Although variations are possible, a gravel pack is generally an accumulation of "gravel" (typically sand, proppant or another granular or particulate material, whether naturally occurring or synthetic) about a tubular filter or screen in a wellbore. The gravel is sized, so that it will not pass through the screen, and so that sand, debris and fines from an earth formation penetrated by the wellbore will not easily pass through the gravel pack with fluid flowing from the formation. Although relatively uncommon, a gravel pack may also be used in an injection well, for example, to support an unconsolidated formation.

Placing the gravel about the screen in the wellbore is a complicated process, requiring relatively sophisticated equipment and techniques to maintain well integrity while ensuring the gravel is properly placed in a manner that provides for subsequent efficient and trouble-free operation. It will, therefore, be readily appreciated that improvements are continually needed in the arts of designing and utilizing gravel pack equipment and methods. Such improved equipment and methods may be useful with any type of gravel pack in cased or open wellbores, and in vertical, horizontal or deviated well sections.

The improved equipment and methods may also be used in other types of well operations. For example, drilling, fracturing, conformance, steam flooding, disposal and other operations could utilize concepts described more fully below.

DETAILED DESCRIPTION

Figure 1:
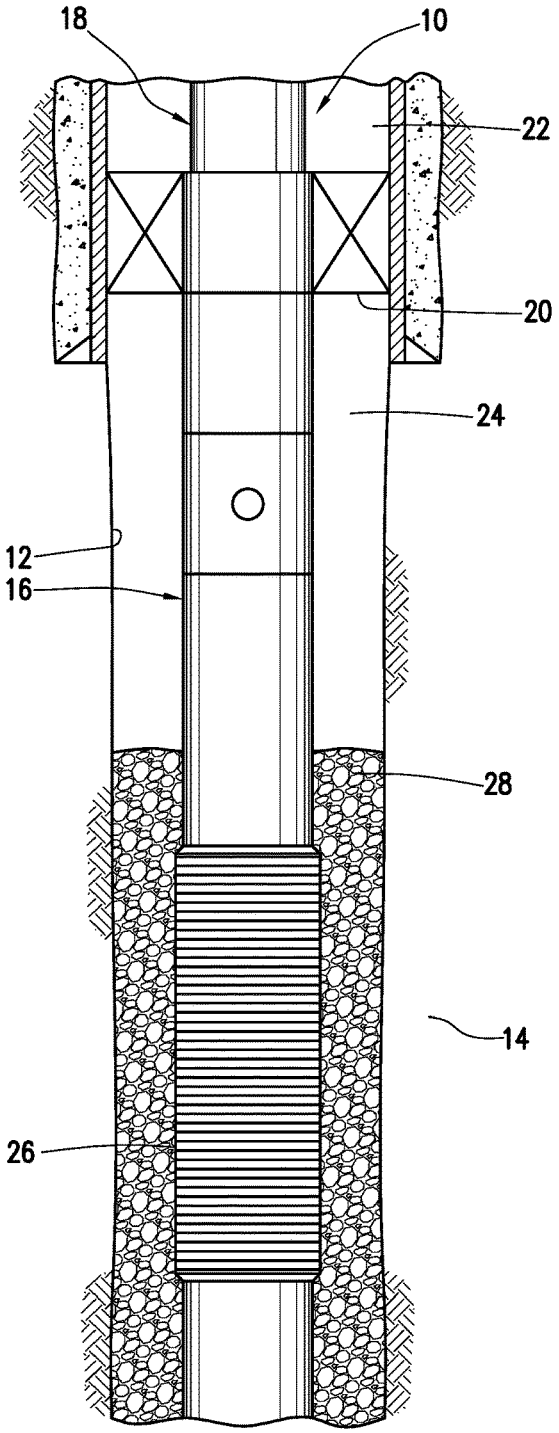
FIG. 1 is a representative partially cross-sectional view of an example of a gravel pack system and associated method which can embody principles of this disclosure.

Representatively illustrated in FIG. 1 is a gravel pack system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled, so that it penetrates an earth formation 14. A well completion assembly 16 is installed in the wellbore 12, for example, using a generally tubular service string 18 to convey the completion assembly and set a packer 20 of the completion assembly.

Setting the packer 20 in the wellbore 12 provides for isolation of an upper well annulus 22 from a lower well annulus 24 (although, as described above, at the time the packer is set, the upper annulus and lower annulus may be in communication with each other). The upper annulus 22 is formed radially between the service string 18 and the wellbore 12, and the lower annulus 24 is formed radially between the completion assembly 16 and the wellbore.

The terms "upper" and "lower" are used herein for convenience in describing the relative orientations of the annulus 22 and annulus 24 as they are depicted in FIG. 1. In other examples, the wellbore 12 could be horizontal (in which case neither of the annuli would be above or below the other) or otherwise deviated. Thus, the scope of this disclosure is not limited to any relative orientations of examples as described herein.

As depicted in FIG. 1, the packer 20 is set in a cased portion of the wellbore 12, and a generally tubular well screen 26 of the completion assembly 16 is positioned in an uncased or open hole portion of the wellbore. However, in other examples, the packer 20 could be set in an open hole portion of the wellbore 12, and/or the screen 26 could be positioned in a cased portion of the wellbore. Thus, it will be appreciated that the scope of this disclosure is not limited to any particular details of the system 10 as depicted in FIG. 1, or as described herein.

In the FIG. 1 method, the service string 18 not only facilitates setting of the packer 20, but also provides a variety of flow passages for directing fluids to flow into and out of the completion assembly 16, the upper annulus 22 and the lower annulus 24. One reason for this flow directing function of the service string 18 is to deposit gravel 28 in the lower annulus 24 about the well screen 26.

Examples of some steps of the method are representatively depicted in FIGS. 2-7 and are described more fully below. However, it should be clearly understood that it is not necessary for all of the steps depicted in FIGS. 2-7 to be performed, and additional or other steps may be performed, in keeping with the principles of this disclosure.

Figure 2:
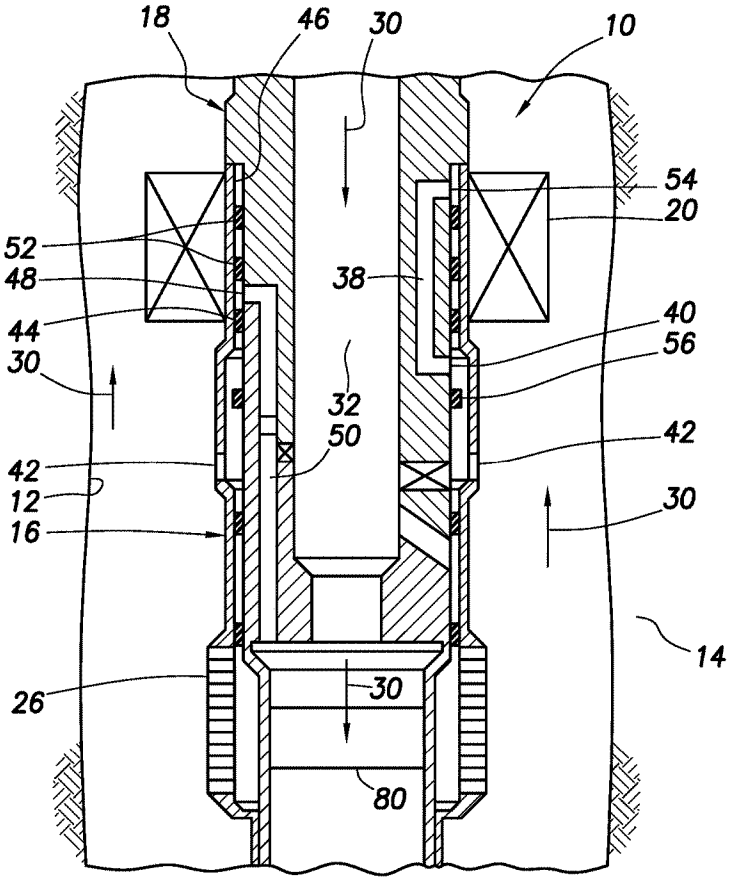

Referring now to FIG. 2, the system 10 is depicted as the service string 18 is being used to convey and position the completion assembly 16 in the wellbore 12. For clarity of illustration, the cased portion of the wellbore 12 is not depicted in FIGS. 2-7.

Note that, as shown in FIG. 2, the packer 20 is not yet set, and so the completion assembly 16 can be displaced through the wellbore 12 to any desired location. As the completion assembly 16 is displaced into the wellbore 12 and positioned therein, a fluid 30 can be circulated through a flow passage 32 that extends longitudinally through the service string 18. The fluid 30 can flow through an open valve assembly 80 of the service string 18.

Figure 3:
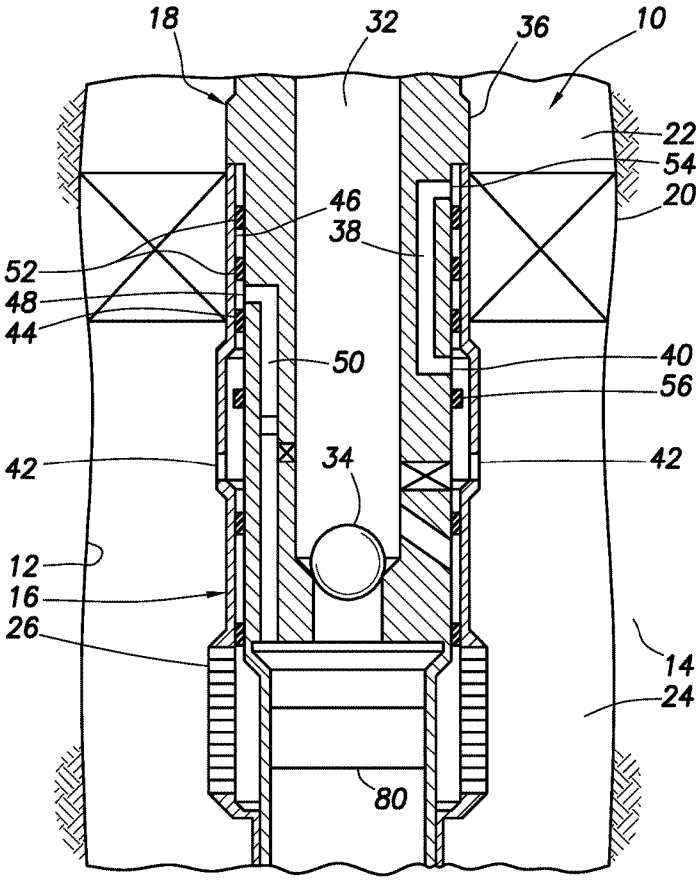
FIGS. 2-7 are representative cross-sectional views of a succession of steps in the method of gravel packing.

As depicted in FIG. 3, the completion assembly 16 has been appropriately positioned in the wellbore 12, and the packer 20 has been set to thereby provide for isolation between the upper annulus 22 and the lower annulus 24. In this example, to accomplish setting of the packer 20, a ball, dart or other plug 34 is deposited in the flow passage 32 and, after the plug 34 seals off the flow passage, pressure in the flow passage above the plug is increased.

This increased pressure operates a packer setting tool 36 of the service string 18. The setting tool 36 can be of the type well known to those skilled in the art, and so further details of the setting tool and its operation are not illustrated in the drawings or described herein.

Although the packer 20 in this example is set by application of increased pressure to the setting tool 36 of the service string 18, in other examples the packer may be set using other techniques. For example, the packer 20 could be set by manipulation of the service string 18 (e.g., rotating in a selected direction and then setting down or pulling up, etc.), with or without application of increased pressure. Thus, the scope of this disclosure is not limited to any particular technique for setting the packer 20.

Note that, although the set packer 20 separates the upper annulus 22 from the lower annulus 24, in the step of the method as depicted in FIG. 3, the upper annulus and lower annulus are not yet fully isolated from each other. Instead, another flow passage 38 in the service string 18 provides for fluid communication between the upper annulus 22 and the lower annulus 24.

In FIG. 3, it may be seen that a lower port 40 permits communication between the flow passage 38 and an interior of the completion assembly 16. Openings 42 formed through the completion assembly 16 permit communication between the interior of the completion assembly and the lower annulus 24. The valve assembly 80 remains in its open configuration.

An annular seal 44 is sealingly received in a seal bore 46. The seal bore 46 is located within the packer 20 in this example, but in other examples, the seal bore could be otherwise located (e.g., above or below the packer).

In the step as depicted in FIG. 3, the seal 44 isolates the port 40 from another port 48 that provides communication between another flow passage 50 and an exterior of the service string 18. At this stage of the method, no flow is permitted through the port 48, because one or more additional annular seals 52 on an opposite longitudinal side of the port 48 are also sealingly received in the seal bore 46.

An upper end of the flow passage 38 is in communication with the upper annulus 22 via an upper port 54. Although not clearly visible in FIG. 3, relatively small annular spaces between the setting tool 36 and the packer 20 provide for communication between the port 54 and the upper annulus 22.

Thus, it will be appreciated that the flow passage 38 and ports 40, 54 effectively bypass the seal bore 46 (which is engaged by the annular seals 44, 52 carried on the service string 18) and allow for hydrostatic pressure in the upper annulus 22 to be communicated to the lower annulus 24. This enhances wellbore 12 stability, in part by preventing pressure in the lower annulus 24 from decreasing (e.g., toward pressure in the formation 14) when the packer 20 is set.

Figure 4:
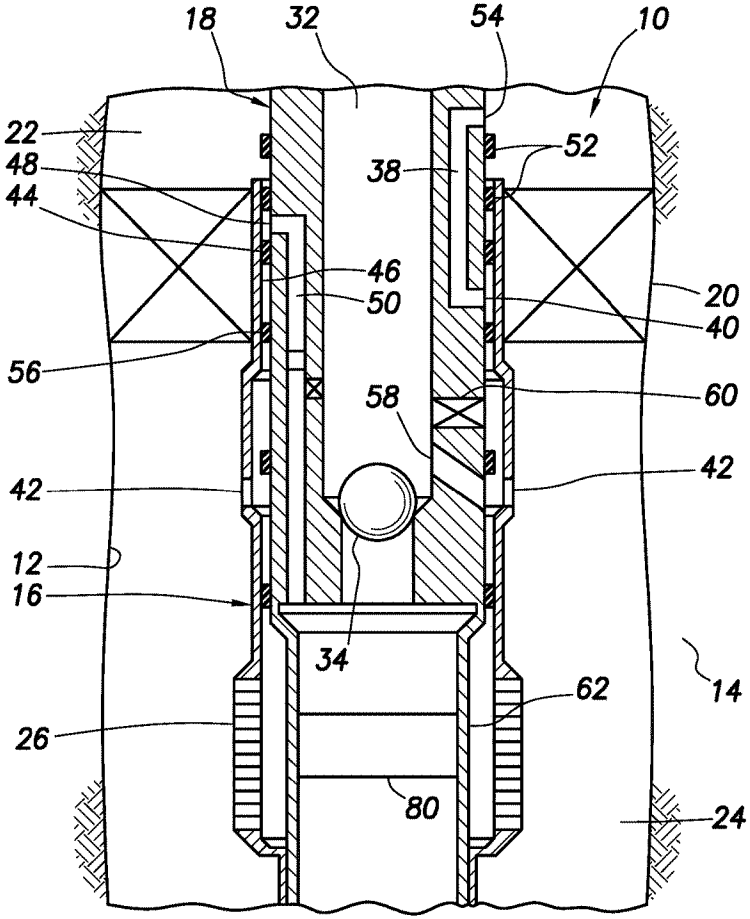

As depicted in FIG. 4, the service string 18 has been raised relative to the completion string 16, which is now secured to the wellbore 12 due to previous setting of the packer 20. In this position, another annular seal 56 carried on the service string 18 is now sealingly engaged in the seal bore 46, thereby isolating the flow passage 38 from the lower annulus 24.

However, the flow passage 32 is now in communication with the lower annulus 24 via the openings 42 and one or more ports 58 in the service string 18. Thus, hydrostatic pressure continues to be communicated to the lower annulus 24. The valve assembly 80 remains in its open configuration.

The lower annulus 24 is isolated from the upper annulus 22 by the packer 20. The flow passage 38 is not in communication with the lower annulus 24 due to the annular seal 56 in the seal bore 46. The flow passage 50 may be in communication with the lower annulus 24, but no flow is permitted through the port 48 due to the annular seal 52 in the seal bore 46. Thus, the lower annulus 24 is isolated completely from the upper annulus 22.

In the FIG. 4 position of the service string 18, the packer 20 can be tested by applying increased pressure to the upper annulus 22 (for example, using surface pumps). If there is any leakage from the upper annulus 22 to the lower annulus 24, this leakage will be transmitted via the openings 42 and ports 58 to surface via the flow passage 32, so it will be apparent to operators at surface and remedial actions can be taken.

Figure 5:
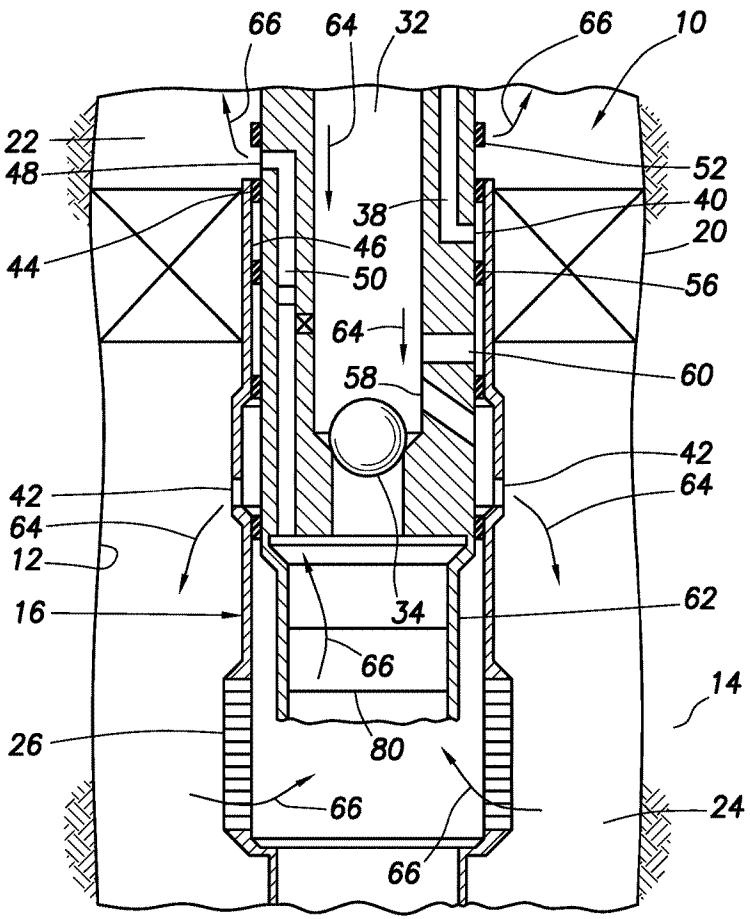

As depicted in FIG. 5, a reversing valve 60 has been opened by raising the service string 18 relative to the completion assembly 16, so that the annular seal 56 is above the seal bore 46, and then applying pressure to the upper annulus 22 to open the reversing valve. The service string 18 is then lowered to its FIG. 5 position (which is raised somewhat relative to its FIG. 4 position).

Thus, in this example, the reversing valve 60 is an annular pressure-operated sliding sleeve valve of the type well known to those skilled in the art, and so operation and construction of the reversing valve is not described or illustrated in more detail by this disclosure. However, it should be clearly understood that the scope of this disclosure is not limited to use of any particular type of reversing valve, or to any particular technique for operating a reversing valve.

The raising of the service string 18 relative to the completion assembly 16 can facilitate operations other than opening of the reversing valve 60. In this example, the raising of the service string 18 can function to close a valve assembly 80 connected in or below a washpipe 62 of the service string, as described more fully below. The valve assembly 80 can (when closed) substantially or completely prevent flow from the flow passage 32 into an interior of the well screen 26.

In the FIG. 5 position, the flow passage 32 is in communication with the lower annulus 24 via the openings 42 and ports 58. In addition, the flow passage 50 is in communication with the upper annulus 22 via the port 48. The flow passage 50 is also in communication with an interior of the well screen 26 via the washpipe 62.

A gravel slurry 64 (a mixture of the gravel 28 and one or more fluids 66) can now be flowed from surface through the flow passage 32 of the service string 18, and outward into the lower annulus 24 via the openings 42 and ports 58. The fluids 66 can flow inward through the well screen 26, into the washpipe 62, and to the upper annulus 22 via the flow passage 50 for return to surface. In this manner, the gravel 28 is deposited into the lower annulus 24 (see FIGS. 6 & 7).

Figure 6:
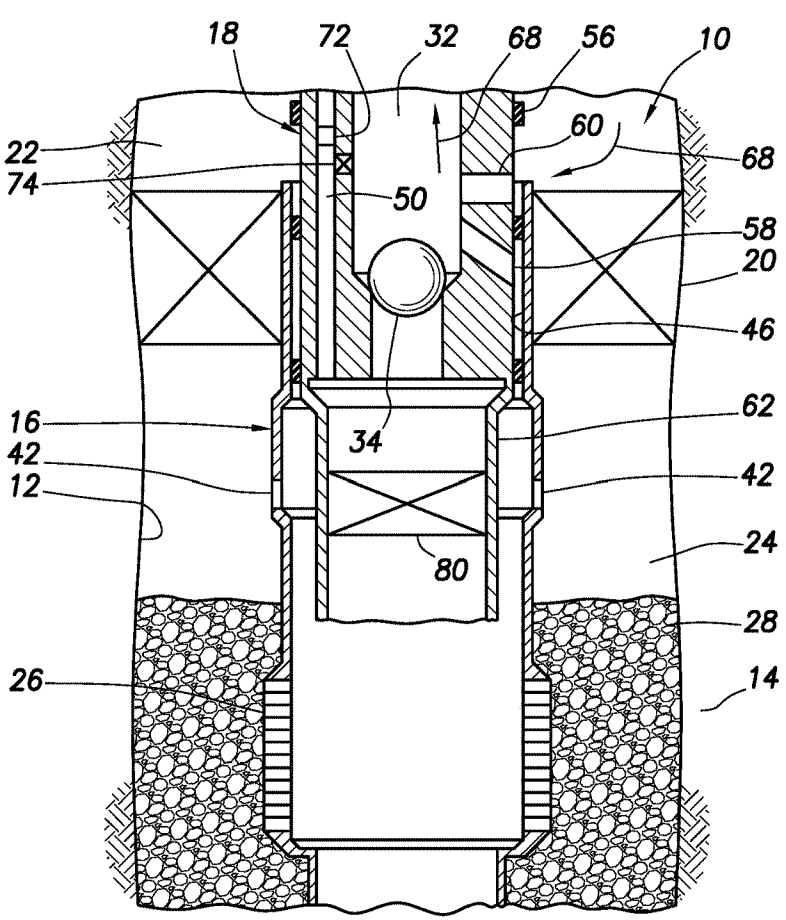

As depicted in FIG. 6, the service string 18 has been raised further relative to the completion assembly 16 after the gravel slurry 64 pumping operation is concluded. The annular seal 56 is now out of the seal bore 46, thereby exposing the reversing valve 60 again to the upper annulus 22. The valve assembly 80 is in its closed configuration.

A clean fluid 68 can now be circulated from surface via the upper annulus 22 and inward through the open reversing valve 60, and then back to surface via the flow passage 32. This reverse circulating flow can be used to remove any gravel 28 remaining in the flow passage 32 after the gravel slurry 64 pumping operation.

After reverse circulating, the service string 18 can be conveniently retrieved to surface and a production tubing string (not shown) can be installed. Flow through the openings 42 is prevented when the service string 18 is withdrawn from the completion assembly 16 (e.g., by shifting a sleeve of the type known to those skilled in the art as a closing sleeve). A lower end of the production tubing string can be equipped with annular seals and stabbed into the seal bore 46, after which fluids can be produced from the formation 14 through the gravel 28, then into the well screen 26 and to surface via the production tubing string.

Figure 7:
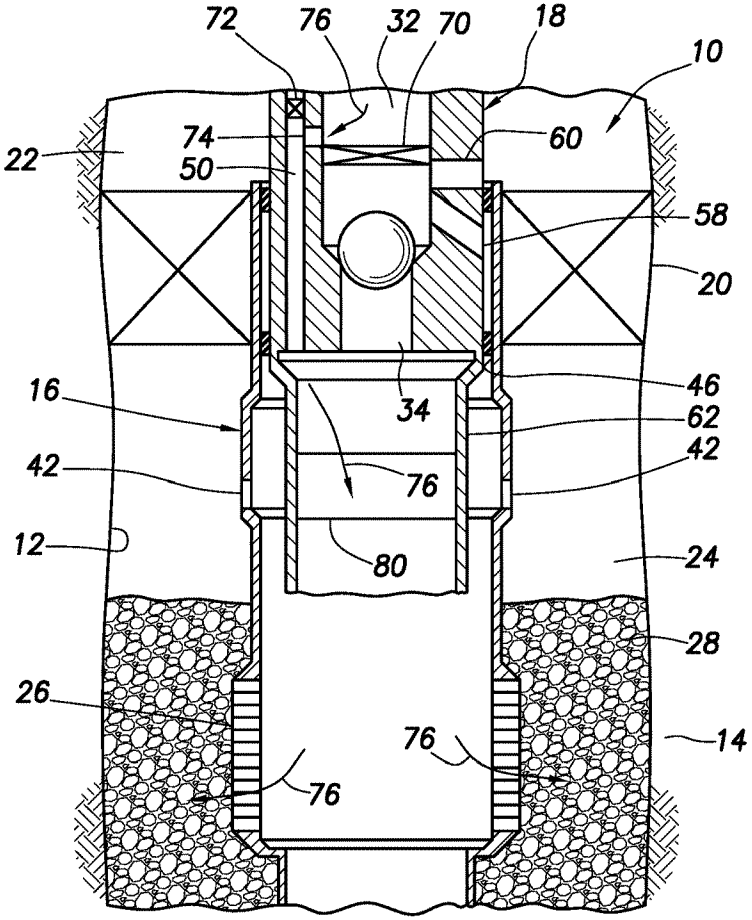

An optional treatment step is depicted in FIG. 7. This treatment step can be performed after the reverse circulating step of FIG. 6, and before retrieval of the service string 18.

As depicted in FIG. 7, another ball, dart or other plug 70 is installed in the flow passage 32, and then increased pressure is applied to the flow passage. This increased pressure causes a lower portion of the flow passage 50 to be isolated from an upper portion of the flow passage (e.g., by closing a valve 72), and also causes the lower portion of the flow passage 50 to be placed in communication with the flow passage 32 above the plug 70 (e.g., by opening a valve 74). Suitable valve arrangements for use as the valves 72, 74 are described in U.S. Pat. Nos. 6,702,020 and 6,725,929, although other valve arrangements may be used in keeping with the principles of this disclosure.

The lower portion of the flow passage 50 is, thus, now isolated from the upper annulus 22. However, the lower portion of the flow passage 50 now provides for communication between the flow passage 32 and the interior of the well screen 26 via the washpipe 62. Note, also, that the lower annulus 24 is isolated from the upper annulus 22.

A treatment fluid 76 can now be flowed from surface via the flow passages 32, 50 and washpipe 62 to the interior of the well screen 26, and thence outward through the well screen into the gravel 28. If desired, the treatment fluid 76 can further be flowed into the formation 14.

The treatment fluid 76 could be any type of fluid suitable for treating the well screen 26, gravel 28, wellbore 12 and/or formation 14. For example, the treatment fluid 76 could comprise an acid for dissolving a mud cake (not shown) on a wall of the wellbore 12, or for dissolving contaminants deposited on the well screen 26 or in the gravel 28. Acid may be flowed into the formation 14 for increasing its permeability. Conformance agents may be flowed into the formation 14 for modifying its wettability or other characteristics. Breakers may be flowed into the formation 14 for breaking down gels used in a previous fracturing operation. Thus, it will be appreciated that the scope of this disclosure is not limited to use of any particular treatment fluid, or to any particular purpose for flowing treatment fluid into the completion assembly 16.

As depicted in FIG. 7, the valve assembly 80 is again in its open configuration. In this open configuration of the valve assembly 80, the service string 18 can be retrieved from the well, without "swabbing" (decreasing pressure in) the well below the packer 20. The valve assembly 80 can be opened for retrieval of the service string 18, whether or not a treatment operation is performed (e.g., the valve assembly can be opened after the reverse circulation step of FIG. 6, whether or not the treatment fluid 76 is flowed into the well as depicted in FIG. 7).

Although only a single packer 20, well screen 26 and gravel packing operation is described above for the FIGS. 1-7 example, in other examples multiple packers and well screens may be provided, and multiple gravel packing operations may be performed, for respective multiple different zones or intervals of the formation 14 or multiple formations. The scope of this disclosure is not limited to any particular number or combination of any components of the system 10, or to any particular number or combination of steps in the method.

Figure 8:
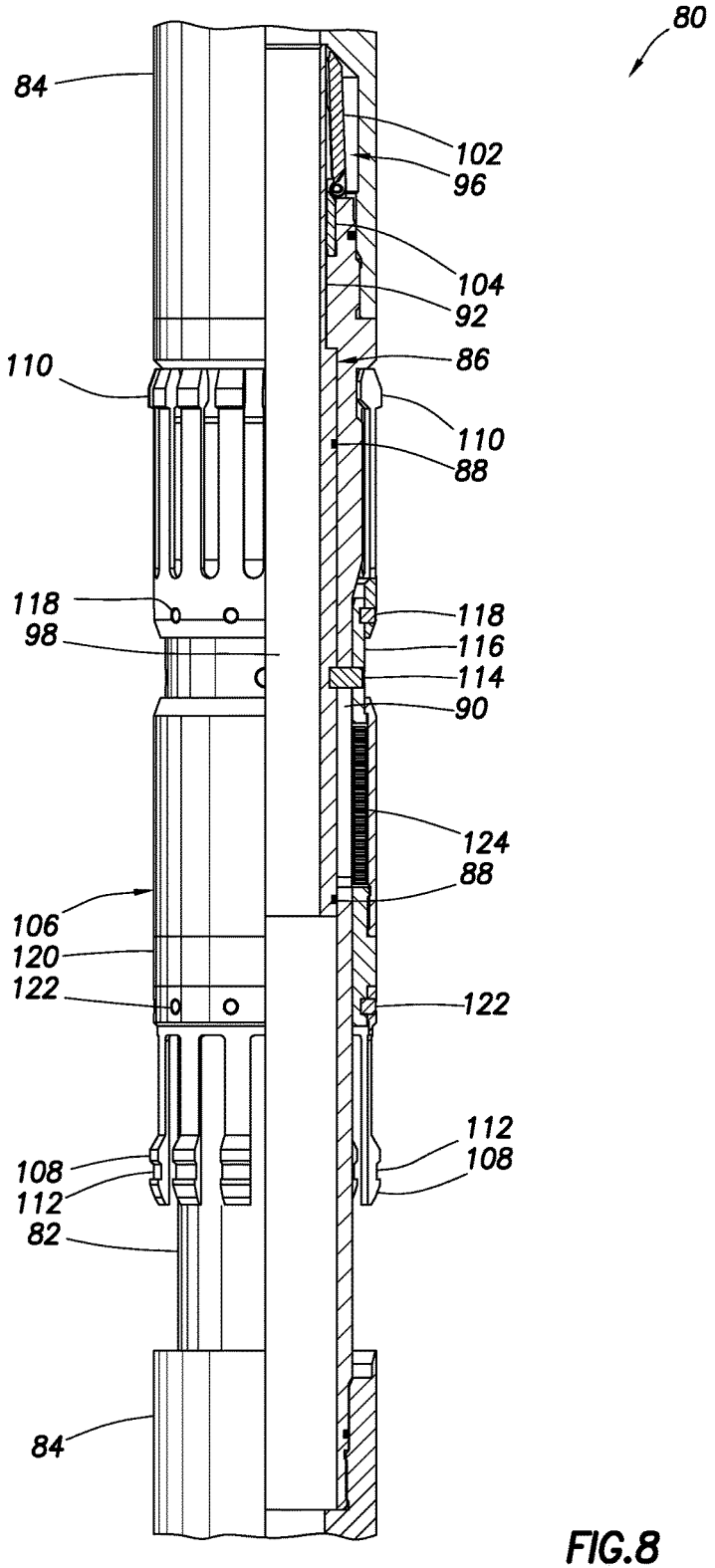
FIG. 8 is a representative enlarged scale partially cross-sectional view of a downhole valve assembly which may be used in the system and method of FIGS. 1-7, the valve assembly being depicted in an open run-in configuration.

Referring additionally now to FIG. 8, the valve assembly 80 is representatively illustrated apart from the remainder of the system 10 and method of FIGS. 1-7. The valve assembly 80 may be used with other systems and methods, and for purposes other than gravel packing, in keeping with the principles of this disclosure.

As depicted in FIG. 8, the valve assembly 80 is in its open configuration. In the FIGS. 1-7 gravel packing example, the valve assembly 80 can be in its open configuration during the FIG. 2 installation step, the FIG. 3 packer setting step, the FIG. 4 packer testing step and the FIG. 7 treatment/retrieval step. Although FIG. 5 depicts the valve assembly 80 in the gravel slurry flowing step as being open as the fluid 66 flows upward through the washpipe 62, it may be the flow that causes the valve assembly to open, in which case the valve assembly could be closed in the absence of the flow.

In the FIG. 8 example, the valve assembly 80 includes a generally tubular housing 82 with end connectors 84 for connecting the valve assembly in a tubular string (such as the washpipe 62). The end connectors 84 may typically be provided with suitable threads, seals, etc., for securing and sealing the valve assembly 80 in the tubular string.

Sealingly and reciprocably received in the housing 82 is a generally tubular mandrel 86. Seals 88 carried on the mandrel 86 prevent fluid communication through a longitudinally extending slot 90 formed through the housing 82.

At an upper end (as viewed in FIG. 8), a generally tubular extension or opening prong 92 is formed on the mandrel 86. In the open configuration of FIG. 8, the opening prong 92 maintains a flapper valve 96 open, thereby permitting relatively unrestricted flow in both directions through a flow passage 98 extending longitudinally through the valve assembly 80. When used with the system 10 of FIGS. 1-7, the flow passage 98 forms a lower section of the flow passage 32.

The flapper valve 96 includes a closure or flapper 102 pivotably secured relative to a seat 104. The seat 104 is received in an upper end of the housing 82, and is configured for sealing engagement with the flapper 102 when the flapper valve 96 is closed (see FIG. 10). If another type of valve is used (such as, a ball valve, or sliding or rotary sleeve valve), a closure of the valve may not be a flapper.

As depicted in FIG. 8, the opening prong 92 maintains the flapper 102 pivoted upward and out of sealing engagement with the seat 104. A biasing device (such as a torsion spring, not visible in FIG. 8) may be used to bias the flapper 102 toward sealing engagement with the seat 104 when the opening prong 92 is displaced downward, as described more fully below.

Reciprocably disposed on the housing 82 is an engagement device 106 including two sets of circumferentially distributed and longitudinally extending engagement members or collets 108, 110. The collets 108 are configured for releasable engagement with one or more internal profiles in an outer tubular string (such as the completion assembly 16).

Although the engagement members are depicted as collets 108, 110 in the drawings, in other examples different types of engagement members may be used. For example, keys, lugs, dogs or other engagement members may be used.

The collets 108 in this example are resilient, due to their elasticity, and so they can be deflected radially inwardly and outwardly. As described more fully below, such deflections are useful for engaging and disengaging from an internal profile in the outer tubular string. The collets 108 may be provided with an external profile 112 that is complementarily shaped relative to the internal profile in the outer tubular string, to enable selective engagement therewith.

The collets 110 are also resilient to provide for radially inward and outward deflection. The collets 110 can also engage an internal profile in the outer tubular string (the same internal profile or a different profile from that engaged by the collets 108), but in this example the collets 110 are not provided with a complementarily shaped external profile. Thus, any engagement between the collets 110 and an internal profile in the outer tubular string is non-selective.

A pin 114 is secured to a sleeve 116 of the engagement device 106, extends through the slot 90, and is secured to the mandrel 86. In this manner, the mandrel 86 and the engagement device 106 can reciprocably displace together relative to the housing 82.

The collets 110 are secured to the sleeve 116 with shearable screws 118 or other releasable members. Similarly, the collets 108 are secured to another sleeve 120 with shearable screws 122 or other releasable members.

The collets 110 and sleeve 116 can be displaced toward the collets 108 and sleeve 120 by compressing a biasing device 124 (such as, a coiled, Bellville, or wave spring, a compressed gas chamber, an elastomer, a compressible liquid, etc.) between the sleeves 116, 120. The biasing device 124 exerts opposing biasing forces against the sleeves 116, 120, thereby urging the sleeves apart to their FIG. 8 configuration.

As depicted in FIG. 8, the engagement device 106 is in a fully upwardly displaced position relative to the housing 82. In this position, the opening prong 92 maintains the flapper valve 96 open.

In this configuration, the valve assembly 80 can be displaced through a tubular string (such as the completion assembly 16) in a downward direction. If the tubular string includes one or more internal profiles engageable by the collets 108, the collets may momentarily engage the profile (s), but the collets will disengage from the profile(s) as soon as a sufficient downward force is applied to cause the collets to deflect inward (due to mating surfaces on the collets 108 and the internal profiles being angled somewhat). Thus, in the FIG. 8 configuration, downward displacement of the valve assembly 80 will not cause any actuation of the valve assembly.

Figure 9:
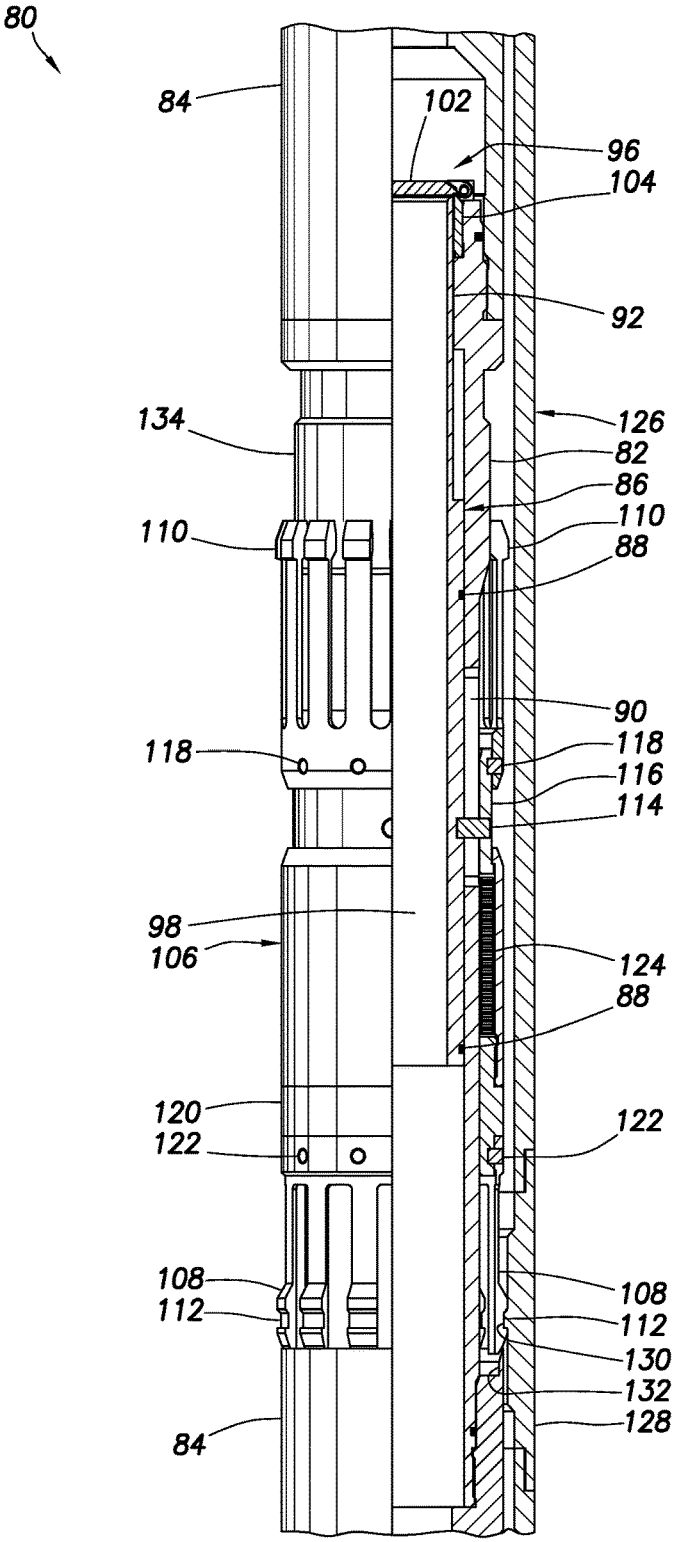
FIG. 9 is a representative partially cross-sectional view of the valve assembly as it is engaged with an internal profile and in a closed configuration.

Referring additionally now to FIG. 9, the valve assembly 80 is representatively illustrated as being reciprocably disposed within a tubular string 126. The tubular string 126 could comprise a section of the completion assembly 16 of the FIGS. 1-7 example, or it may be another type of tubular string in other examples.

The tubular string 126 includes a coupling 128 having an internal radially inwardly extending shoulder or profile 130 formed therein. The profile 130 is complementarily shaped relative to the recessed profile 112 on each of the collets 108.

As depicted in FIG. 9, the valve assembly 80 has been displaced upwardly relative to the tubular string 126, thereby causing the collets 108 to releasably engage the profile 130 in the coupling 128. After the collets 108 have engaged the profile 130, this engagement will cause the engagement device 106 and mandrel 86 to remain stationary relative to the tubular string 126 while the remainder of the valve assembly 80 (including the housing 82, connectors 84 and flapper valve 96) displaces further upward. Thus, the housing 82, connectors 84 and flapper valve 96 displace upward relative to the engagement device 106 and mandrel 86.

The valve 96 is now closed, preventing (or at least substantially restricting) downward flow through the passage 98. The opening prong 92 no longer prevents the flapper 102 from pivoting downward into sealing engagement with the seat 104. However, upward flow through the passage 98 can cause the flapper 102 to pivot upward out of sealing engagement with the seat 104.

Thus, in the closed configuration, the flapper valve 96 functions as a check valve, permitting relatively unrestricted flow in only one direction through the passage 98. In the example of FIGS. 1-7, the valve assembly 80 may be in this configuration during pumping of the gravel slurry 64 (see FIG. 5, the flapper valve 96 being opened by flow of the fluid 66 upwardly through the passage 98), and during the reverse circulating step of FIG. 6.

Figure 10:
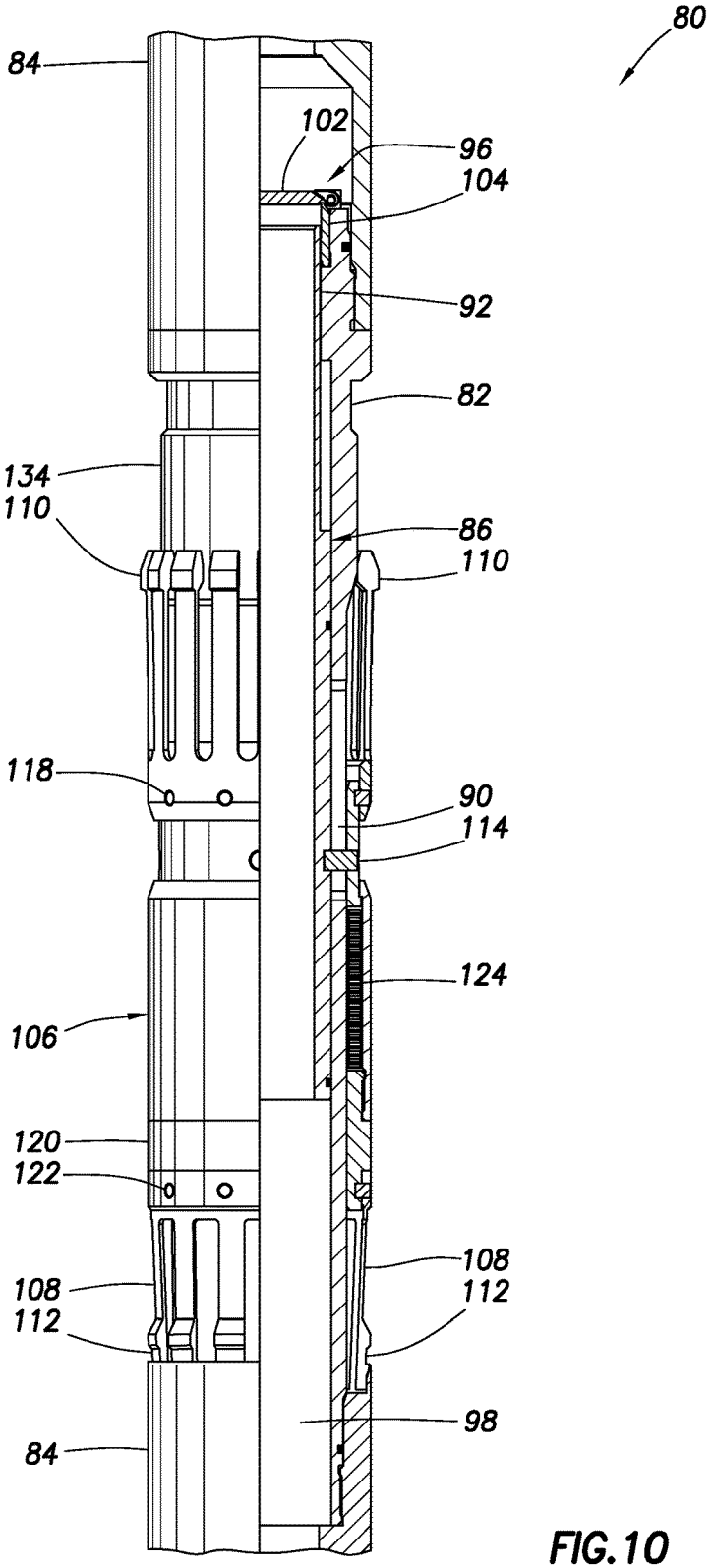
FIG. 10 is a representative partially cross-sectional view of the valve assembly in the closed configuration after displacement through the internal profile.

The valve assembly 80 in the closed configuration of FIGS. 9 & 10 may or may not completely prevent flow through the passage 98. In some examples, a small hole can be provided to allow a small amount of fluid seepage through the flapper valve 96. This would allow the service string 18 to be retrieved, even if the valve assembly 80 fails to be reopened in the FIGS. 1-7 example.

The collets 108 will remain in engagement with the profile 130 until the housing 82 has displaced upward sufficiently relative to the engagement device 106 for the collets to be received in a radially reduced recess 132 formed in the lower connector 84. This radially inwardly deflects the collets 108 out of engagement with the profile 130, as depicted in FIG. 10. Alternatively, the collets 108 could in other examples be disengaged from the profile 130 by applying a sufficient upward force to the valve assembly 80 (due to mating surfaces on the collets 108 and the internal profile 130 being angled somewhat), without use of the recess 132.

As described above regarding the open configuration of FIG. 8, the valve assembly 80 can displace downwardly through the tubular string 126 and traverse one or more profiles 130, without causing actuation of the valve assembly between its open and closed configurations. However, as the valve assembly 80 is displaced upwardly through the tubular string 126, the collets 108 will eventually engage a profile 130, the engagement device 106 and mandrel 86 will cease displacing relative to the tubular string (thereby causing the valve 96 to close), and then the collets will disengage from the profile 130.

Note that, in the closed configuration of FIGS. 9 & 10, the collets 110 are radially outwardly deflected by an external radially enlarged section 134 of the housing 82. As described more fully below, this outward deflection of the collets 110 provides for later opening of the valve 96 (after the valve has been closed) in response to downward displacement of the valve assembly 80 through an internal profile.

Figure 11:
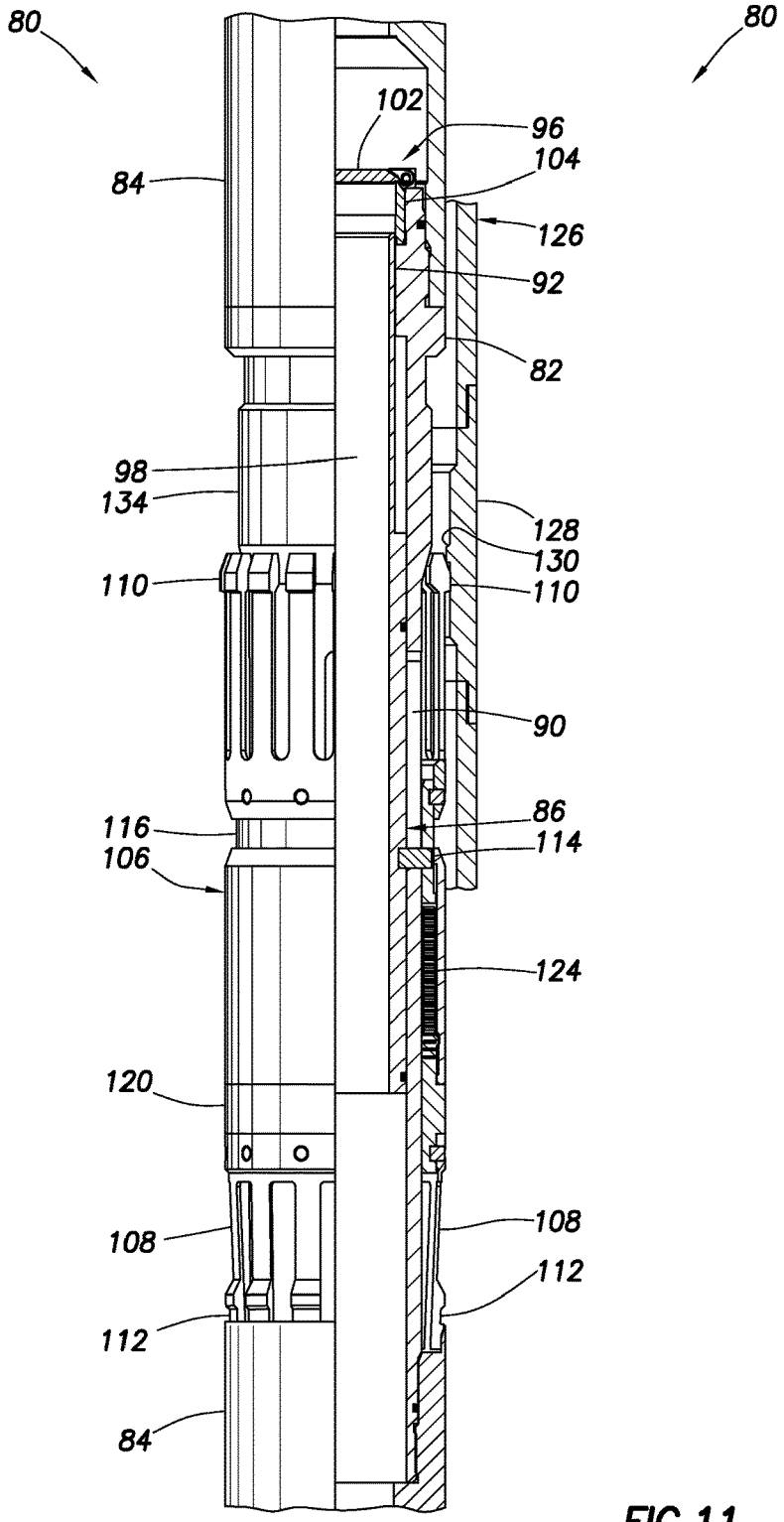
FIG. 11 is a representative partially cross-sectional view of the valve assembly as it is engaged with another internal profile and in a closed configuration.

Referring additionally now to FIG. 11, the valve assembly 80 is representatively illustrated after the collets 108 have disengaged from the profile 130, and the valve assembly 80 is displaced upwardly in the tubular string 126. If the collets 110 in their outwardly deflected positions (see FIGS. 9 & 10) engage the same or another internal profile 130, the biasing device 124 will compress and allow the radially enlarged section 134 of the housing 82 to displace upwardly relative to the collets 110.

As depicted in FIG. 11, the radially enlarged section 134 has displaced upward relative to the collets 110, so that the collets are no longer outwardly supported by the radially enlarged section. The collets 110 can, thus, deflect radially inward and thereby pass through the internal profile 130.

After the collets 110 pass through the internal profile, the biasing device 124 will return the collets to their FIGS. 9 & 10 positions (in which the collets are again radially outwardly supported by the radially enlarged section 134). This allows the valve assembly 80 to displace upwardly through one or more internal profiles 130, while in its closed configuration, even though the radially enlarged section 134 has been previously displaced to its position outwardly supporting the collets 110 (as in FIGS. 9 & 10).

Figure 12:
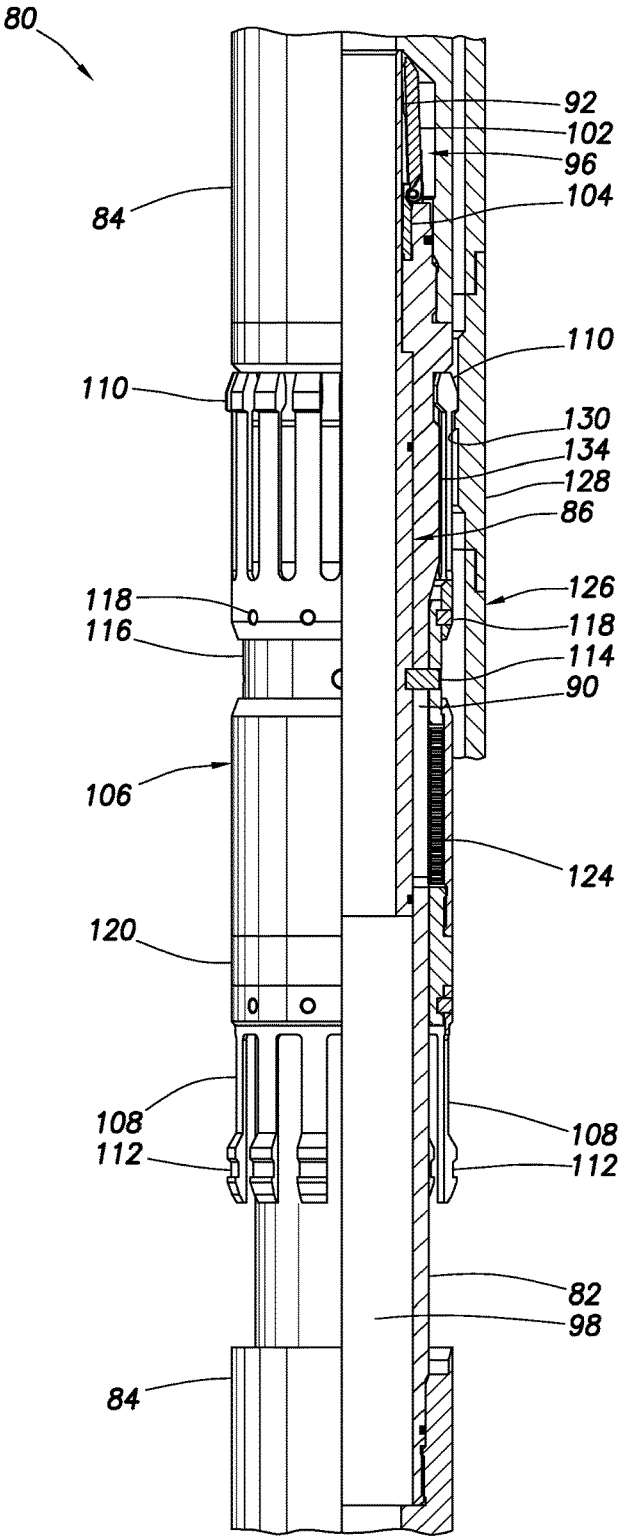
FIG. 12 is a representative partially cross-sectional view of the valve assembly as it is engaged with another internal profile and in an open configuration.

Referring additionally now to FIG. 12, the valve assembly 80 is representatively illustrated as it is downwardly displaced in the tubular string 126. The collets 110 have contacted an internal profile 130, thereby ceasing downward displacement of the engagement device 106 and mandrel 86. Further downward displacement of the housing 82 and valve 96 causes the opening prong 92 to open the flapper 102, so that the valve assembly 80 is now returned to its open configuration.

Note that the collets 110 are no longer radially outwardly supported by the radially enlarged section 134 of the housing 82. Thus, the collets 110 can deflect radially inward and out of engagement with the internal profile 130. The valve assembly 80 in its open configuration can displace downwardly through one or more of the profiles 130, without actuation of the valve assembly.

The valve assembly 80 can be closed again, if desired, by displacing the valve assembly upwardly through an internal profile 130, so that the collets 108 engage the profile as described above in relation to FIGS. 9 & 10. It will, thus, be appreciated that the valve assembly 80 may be actuated repeatedly to its open and closed configurations by displacing the valve assembly through an internal profile in respective downward and upward directions.

Although the drawings of the FIGS. 8-12 example depict only the internal profile 130 for shifting the engagement device 106 and mandrel 86 relative to the housing 82 and valve 96, it should be clearly understood that any type, number, configuration or combination of profile(s) may be used in other examples. It is not necessary for the internal profile 130 to have a shape complementary to or matching a profile (such as the profile 112) on the collets 108 or 110. For example, simple shoulders or other abutments can be used for the profiles 130.

In another example, the entire valve assembly 80 could be inverted from its FIGS. 8-12 orientation, in which case the flapper valve 96 when closed could prevent (or at least substantially restrict) upward flow through the passage 98, but permit relatively unrestricted downward flow through the passage. The valve assembly 80 could be actuated to its open configuration in response to upward displacement through an internal profile, and could be actuated to its closed configuration in response to downward displacement through the same or a different internal profile. Thus, the scope of this disclosure is not limited to any particular orientation or manner of actuating the valve assembly 80.

Figure 13:
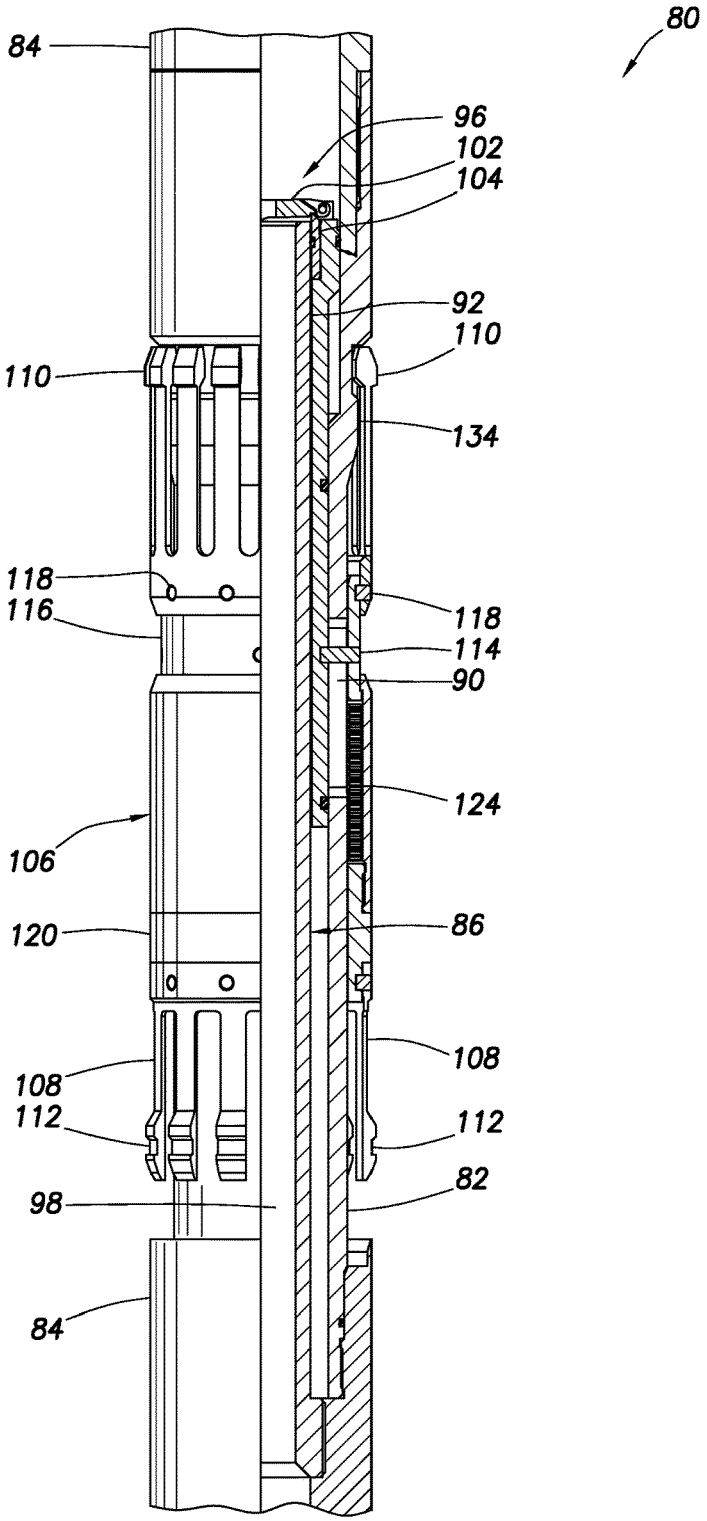
FIGS. 13 & 14 are representative cross-sectional views of another example of the valve assembly in respective closed and open configurations.
Figure 14:
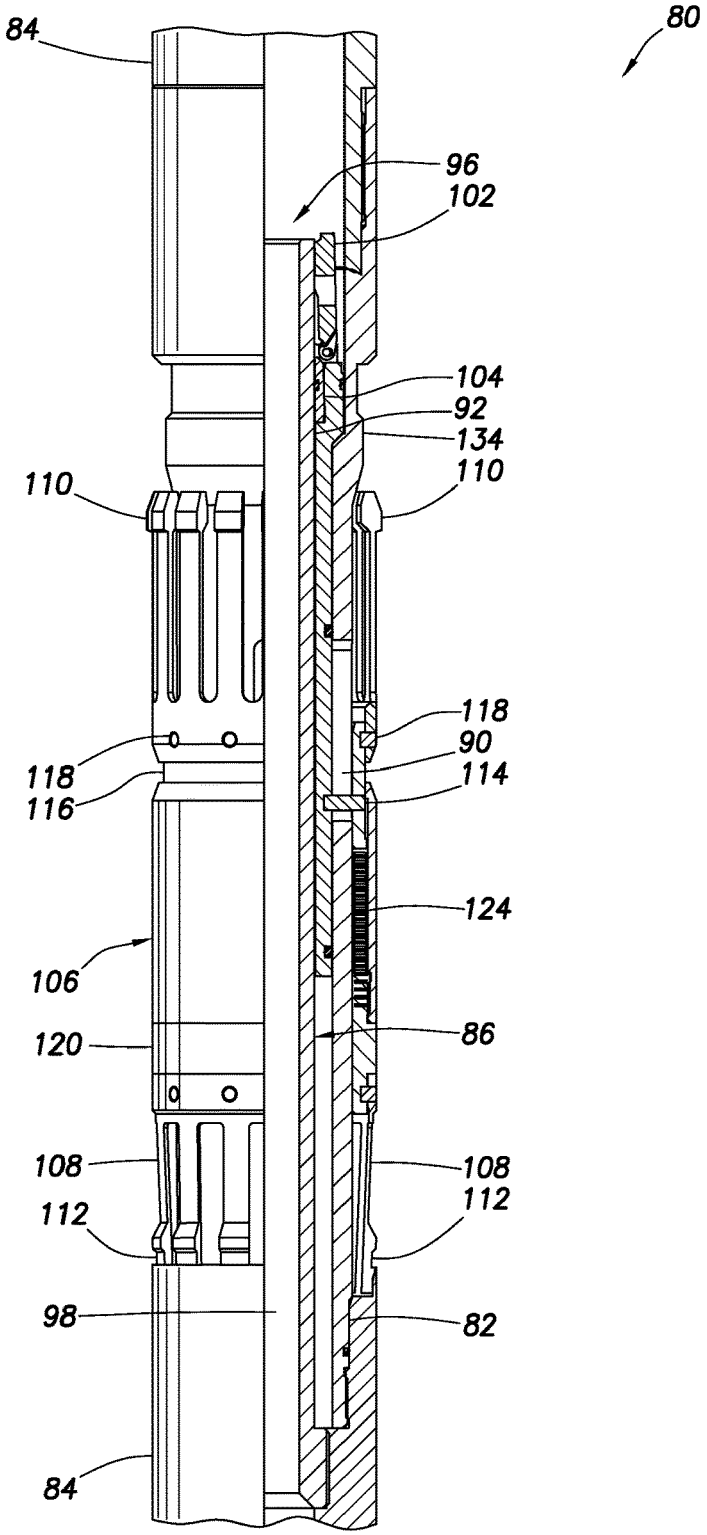

Referring additionally now to FIGS. 13 & 14, another example of the valve assembly 80 is representatively illustrated in respective closed and open configurations. In this example, the mandrel 86 is not displaced relative to the housing 82 to operate the flapper valve 96. Instead, the engagement device 106 is connected to the flapper valve 96 via the pin 114, and thus the flapper valve displaces with the engagement device relative to the housing 82. Otherwise, operation of the FIGS. 13 & 14 example is substantially the same as that described above for the FIGS. 8-12 example.

As depicted in FIG. 13, the flapper valve 96 and engagement device 106 are in an upwardly displaced position, and the flapper 102 is positioned above the opening prong 92 and pivoted downward to its closed position. As depicted in FIG. 14, the flapper valve 96 and engagement device 106 are in a downwardly displaced position, and the opening prong 92 now extends through the seat 104 and pivots the flapper 102 to its open position.

It may now be fully appreciated that the above disclosure provides significant advancements to the arts of constructing and operating downhole valves. In examples described above, the valve assembly 80 can provide for enhanced convenience and reliable operation in gravel packing and other well operations.

The above disclosure provides to the art a valve assembly 80 for use in a subterranean well. In one example, the valve assembly 80 can include a valve 96 that controls flow through a passage 98 extending longitudinally through the valve assembly 80, and an engagement device 106 including at least first and second engagement members (e.g., collets 108, 110). The valve 96 closes in response to displacement of the valve assembly 80 in a first longitudinal direction (e.g., upward in the FIGS. 8-12 example) and engagement between the first engagement member 108 and a first internal profile 130 of an outer tubular string 126. The valve 96 opens in response to displacement of the valve assembly 80 in a second longitudinal direction (e.g., downward in the FIGS. 8-12 example) and engagement between the second engagement member 110 and the first or a second internal profile 130.

The first and second engagement members 108, 110 may be longitudinally separated from each other on the engagement device 106. The engagement device 106 may be reciprocably disposed relative to the valve 96.

The engagement device 106 can be secured to a mandrel 86 that displaces with the engagement device. The mandrel 86 can displace relative to a closure (e.g., the flapper 102) of the valve 96.

The first engagement member 108 may disengage from the first internal profile 130 only when the valve 96 is closed.

The valve may open in response to displacement of the valve assembly 80 in the second longitudinal direction and engagement between the second engagement member 110 and the second internal profile 130.

The second engagement member 110 may be longitudinally displaceable relative to the first engagement member 108. A biasing device 124 may urge the first and second engagement members 108, 110 in opposing directions.

Also provided to the art by the above disclosure is a system 10 for use in a subterranean well. In one example, the system 10 can include a tubular string 126 having at least first and second internal profiles 130; and a valve assembly 80 reciprocably disposed in the tubular string 126. The valve assembly 80 is actuated to a closed configuration in response to displacement of the valve assembly through the first internal profile 130, and the valve assembly is actuated to an open configuration in response to displacement of the valve assembly through the second internal profile 130.

The valve assembly 80 may be actuated to the closed configuration in response to displacement of the valve assembly through the first internal profile 130 in a first longitudinal direction, and the valve assembly may be actuated to the open configuration in response to displacement of the valve assembly through the second internal profile 130 in a second longitudinal direction.

The valve assembly 80 may include first and second engagement members 108, 110 connected to an inner mandrel 86. The first and second engagement members 108, 110 may be longitudinally separated from each other on the valve assembly 80. The inner mandrel 86 may be reciprocably disposed relative to a valve 96 of the valve assembly 80.

The first engagement member 108 may engage the first internal profile 130 in response to displacement of the valve assembly 80 through the first internal profile. The second engagement member 110 may engage the second internal profile 130 in response to displacement of the valve assembly 80 through the second internal profile.

A method of gravel packing a well is also described above. In one example, the method can comprise displacing a service string 18 in first and second opposite longitudinal directions within a completion assembly 16. The service string 18 includes a valve assembly 80 that selectively restricts flow through a longitudinal flow passage 32 of the service string. The valve assembly 80 is opened as the valve assembly displaces in the first longitudinal direction, and the valve assembly 80 is closed as the valve assembly displaces in the second longitudinal direction.

The opening step can comprise ceasing displacement of a first engagement member 108 of the valve assembly 80 in response to engagement between the first engagement member and a first internal profile 130 in the completion assembly 16. The closing step can comprise ceasing displacement of a second engagement member 110 of the valve assembly 80 in response to engagement between the second engagement member and the first or a second internal profile 130 in the completion assembly 16.

The first and second engagement members 108, 110 may be longitudinally spaced apart from each other on the valve assembly 80. The first and second engagement members 108, 110 may be connected to an inner mandrel 86 that reciprocably displaces relative to a valve 96 of the valve assembly 80. The opening step may include radially outwardly extending the second engagement member 110.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A valve assembly for use in a subterranean well, the valve assembly comprising:

a valve that controls flow through a passage extending longitudinally through the valve assembly; and an engagement device including at least first and second engagement members, wherein the valve closes in response to:

displacement of the valve assembly in a first longitudinal direction, engagement between the first engagement member and a first internal profile of an outer tubular string, and continued displacement of the valve relative to the first engagement member in the first longitudinal direction, and wherein the valve opens in response to:

displacement of the valve assembly in a second longitudinal direction, engagement between the second engagement member and the first or a second internal profile, and continued displacement of the valve relative to the second engagement member in the second longitudinal direction.

2. The valve assembly of claim 1, wherein the first and second engagement members are longitudinally separated from each other on the engagement device.

3. The valve assembly of claim 1, wherein the engagement device is reciprocably disposed relative to the valve.

4. The valve assembly of claim 1, wherein the engagement device is secured to a mandrel that displaces with the engagement device, and wherein the mandrel displaces relative to a closure member of the valve.

5. The valve assembly of claim 1, wherein the first engagement member disengages from the first internal profile only when the valve is closed.

6. The valve assembly of claim 1, wherein the valve opens in response to displacement of the valve assembly in the second longitudinal direction and engagement between the second engagement member and the second internal profile.

7. The valve assembly of claim 1, wherein the second engagement member is longitudinally displaceable relative to the first engagement member.

8. The valve assembly of claim 1, wherein a biasing device urges the first and second engagement members in opposing directions.

9. A system for use in a subterranean well, the system comprising;

a tubular string having at least one internal profile; and a valve assembly reciprocably disposed in the tubular string, wherein the valve assembly comprises a valve that controls flow through a passage extending longitudinally through the valve assembly, and wherein the valve is configured to be actuated between open and closed configurations by longitudinal displacement of the valve assembly within the tubular string, whereby an engagement member engages the internal profile and ceases displacement relative to the internal profile, followed by continued longitudinal displacement of the valve assembly relative to the internal profile.

10. The system of claim 9, wherein the valve assembly is actuated to the closed configuration in response to displacement of the valve assembly in a first longitudinal direction, and wherein the valve assembly is actuated to the open configuration in response to displacement of the valve assembly in a second longitudinal direction.

11. The system of claim 9, wherein the valve assembly includes first and second engagement members connected to an inner mandrel.

12. The system of claim 11, wherein the first and second engagement members are longitudinally separated from each other on the valve assembly.

13. The system of claim 11, wherein the inner mandrel is reciprocably disposed relative to the valve of the valve assembly.

14. The system of claim 11, wherein the first engagement member engages a first internal profile in response to displacement of the valve assembly in a first longitudinal direction, and wherein the second engagement member engages a second internal profile in response to displacement of the valve assembly in a second longitudinal direction.

15. A method for use in a subterranean well, the method comprising:

displacing a service string in first and second opposite longitudinal directions within a completion assembly by manipulating an end of the service string at a surface of the well, the service string including a valve assembly that selectively restricts flow through a longitudinal flow passage of the service string;

opening the valve assembly by displacing the valve assembly in the first longitudinal direction, wherein the opening comprises ceasing displacement of a first engagement member of the valve assembly in response to engagement between the first engagement member and a first internal profile in the completion assembly; and closing the valve assembly by displacing the valve assembly in the second longitudinal direction, wherein the closing comprises ceasing displacement of a second engagement member of the valve assembly in response to engagement between the second engagement member and the first or a second internal profile in the completion assembly, and wherein the opening further comprises radially outwardly extending the second engagement member.

16. The method of claim 15, wherein the first and second engagement members are longitudinally spaced apart from each other on the valve assembly.

17. The method of claim 15, wherein the first and second engagement members are connected to an inner mandrel that reciprocably displaces relative to a valve of the valve assembly.

* * * * *